US012527402B2

(12) United States Patent
Sun

(10) Patent No.: US 12,527,402 B2
(45) Date of Patent: Jan. 20, 2026

(54) SWIVEL CHAIR BASE FOR EASY DISASSEMBLY AND TRANSPORTATION AND A SWIVEL CHAIR USING IT

(71) Applicant: Guiting Hu, Bengbu (CN)

(72) Inventor: Guanglin Sun, Baoji (CN)

(73) Assignee: Guiting Hu, Bengbu (CN)

( * ) Notice: Subject to any disclaimer, the term of this patent is extended or adjusted under 35 U.S.C. 154(b) by 221 days.

(21) Appl. No.: 18/379,181

(22) Filed: Oct. 12, 2023

(65) Prior Publication Data

US 2024/0292952 A1 Sep. 5, 2024

(30) Foreign Application Priority Data

Mar. 2, 2023 (CN) ..... 202320420968.4

(51) Int. Cl.

| | |
|---|---|
| ***A47C 3/18*** | (2006.01) |
| ***A47C 4/02*** | (2006.01) |
| ***A47C 7/00*** | (2006.01) |

(52) U.S. Cl.

CPC ..... *A47C 3/18* (2013.01); *A47C 4/02* (2013.01); *A47C 7/004* (2013.01)

(58) Field of Classification Search

CPC ..... A47C 3/18; A47C 4/02; A47C 7/004

See application file for complete search history.

(56) References Cited

U.S. PATENT DOCUMENTS

| | | | | | |
|---|---|---|---|---|---|
| 464,618 | A * | 12/1891 | Wheeler et al. | A47C 7/004 | 248/188.7 |
| 1,637,846 | A * | 8/1927 | Adams | A47C 3/18 | 297/440.22 |
| 1,694,617 | A * | 12/1928 | Brown | A47C 3/24 | 248/188.7 |
| 1,864,535 | A * | 6/1932 | Hach | A47C 3/24 | 248/188.7 |
| 3,197,165 | A * | 7/1965 | Gits | A47C 3/24 | 248/188.7 |
| 3,589,772 | A * | 6/1971 | Leaver | A47C 7/004 | 297/451.3 |
| 4,169,625 | A * | 10/1979 | Petersen | A47C 7/004 | 297/344.26 X |

(Continued)

FOREIGN PATENT DOCUMENTS

| | | | | |
|---|---|---|---|---|
| CN | 211984643 U | * | 11/2020 | |
| IT | 201900001767 A1 | * | 8/2020 | A47C 3/18 |

*Primary Examiner* — Rodney B White

(74) *Attorney, Agent, or Firm* — Jose Cherson Weissbrot

(57) ABSTRACT

A swivel chair base, includes a fixed assembly, a sleeve assembly and a support assembly, the fixed assembly having a fixed frame and a spindle, with the spindle fixed below the fixed frame. The sleeve assembly includes an upper sleeve and a lower sleeve, with the upper sleeve inserted into the lower sleeve and forming a circumferential fixation. The support assembly includes at least two upper support feet, at least two lower support feet and support bracket, with the upper support foot and the lower support foot respectively detachably connected to the support bracket by fasteners, wherein, the spindle is detachably connected to the upper sleeve. An outer wall of the upper sleeve has two symmetrically arranged upper support feet, and the outer wall of the lower sleeve has two symmetrically arranged lower support feet.

20 Claims, 10 Drawing Sheets

(56) References Cited

U.S. PATENT DOCUMENTS 4,411,468 A * 10/1983 Apissomian ..... A47C 3/0252 297/270.1 X
4,607,883 A * 8/1986 Tzu-Chun ..... A47C 1/024 297/320
4,718,723 A * 1/1988 Bottemiller ..... A47C 3/0252 297/302.3
4,768,829 A * 9/1988 Goldman ..... A47C 1/0325 297/344.1
4,786,106 A * 11/1988 Bottemiller ..... A47C 3/0252 297/303.3
5,209,549 A * 5/1993 Chang ..... A47C 1/03255 297/320
5,383,644 A * 1/1995 Huse ..... F16M 11/041 248/501
5,599,064 A * 2/1997 Vanderminden, Sr. ..... A47C 7/445 297/344.21
5,931,530 A * 8/1999 Liu ..... A47C 3/0255 297/344.21
6,575,531 B1 * 6/2003 Tseng ..... F16F 1/06 297/375
6,827,401 B2 * 12/2004 Marshall ..... A47C 1/03255 297/325
6,913,317 B2 * 7/2005 Vanderminden ..... A47C 3/0252 297/344.21
10,376,061 B1 * 8/2019 Liu ..... A47C 3/0255
11,766,126 B1 * 9/2023 Yang ..... A47C 7/004 297/451.4
11,891,149 B2 * 2/2024 Hasegawa ..... A47C 7/006
12,042,054 B2 * 7/2024 Yi ..... A47C 4/02
12,349,807 B2 * 7/2025 Chen ..... A47C 3/029
2019/0343285 A1 * 11/2019 Eouse ..... A47C 3/18
2024/0341478 A1 * 10/2024 Zhao ..... A47C 1/0345
2025/0134257 A1 * 5/2025 Alcorn ..... A47C 7/744
2025/0160520 A1 * 5/2025 Cai ..... A47C 1/0345

* cited by examiner

SWIVEL CHAIR BASE FOR EASY DISASSEMBLY AND TRANSPORTATION AND A SWIVEL CHAIR USING IT

TECHNICAL FIELD

The present invention relates to the technical field of chairs, in particular to a swivel chair base for easy disassembly and transportation and a swivel chair using it.

BACKGROUND

Swivel chair is a very common seating, which generally includes chair frame and set in the chair frame below the base, and the chair frame bottom along the vertical fixed shaft, the base of the installation of the sleeve, the two rotating through the rotating shaft is connected to the sleeve, so as to realize the chair frame can be rotated in the base of the circumferential rotation.

Swivel chairs on the market in order to ensure that the transportation of rotating chairs to make reasonable use of space in the compartment, generally will be divided into spindles and bushings, and then split the chair frame and base, and stacked in turn in the compartment, so as to rationally utilize the space in the compartment, but in fact, due to the installation of bushings and other parts and components of the direction and shape of the reasons, so that the base of the structure is not irregular, in the number of bases in the compartment after the base of the yard, the base of each still exists among the waste of space, resulting in a waste of transportation resources, futilely increasing the cost of transportation.

US20230147575 discloses a unique and novel assembled chair in which the seat of the chair is disassembled into several components so that it can be packaged in a smaller space and then easily assembled by a consumer, the base of the chair being formed in such a manner that the base is divided into at least two components, a first detachable leg component and a second hub component comprising a central support member having a tapered aperture therein, a plurality of fixed legs and a truncated leg receiver constructed and arranged to receive and hold the removable leg component as the chair is assembled. This assembled chair reduces the size of the packaging of the office chair by disassembling the seat of the chair, thereby achieving a reduction in shipping space and a reduction in shipping costs.

The purpose of the present invention application is to provide a new swivel chair base, through the unique disassembly and installation method and base structure, so as to save the space of transportation resources and reduce the transportation cost. The swivel chair base has a simple structure and can be disassembled, with the advantages of simple disassembly, easy operation and space saving, further improving the user experience.

SUMMARY

The present invention provides a type of swivel chair base, comprising:

A fixed assembly, a sleeve assembly and a support assembly,

Said fixed assembly includes fixed frame and spindle, with said spindle fixed below said fixed frame.

Said sleeve assembly includes upper sleeve and lower sleeve, with said upper sleeve inserted into said lower sleeve and forming a circumferential fixation.

Said support assembly includes at least two upper support feet, at least two lower support feet and support bracket, with said upper support foot and said lower support foot respectively detachably connected to said support bracket by fasteners.

Wherein, said spindle is detachably connected to said upper sleeve, the outer wall of said upper sleeve has two symmetrically arranged upper support feet, and the outer wall of said lower sleeve has two symmetrically arranged lower support feet.

The present invention also provides a type of swivel chair, comprising:

A swivel chair base and a chair assembly,

Said swivel chair base includes fixed assembly, sleeve assembly and support assembly. Said fixed assembly includes fixed frame and spindle, with said spindle fixed below said fixed frame. Said sleeve assembly includes upper sleeve and lower sleeve, with inner core provided inside said upper sleeve, several vertically arranged fixing plates spaced along the circumference on the outer wall of said inner core, and said upper sleeve inserted into said lower sleeve to form a circumferential fixation. Said support assembly includes at least two upper support feet, at least two lower support feet and support bracket, with said upper support foot and said lower support foot respectively detachably connected to said support bracket by fasteners. Wherein, the bottom of said spindle is provided with a clip groove, the bottom of said inner core is provided with a clip block, the bottom of said inner core is connected inside the bottom of said spindle, the outer wall of said upper sleeve has two symmetrically arranged upper support feet, and the outer wall of said lower sleeve has two symmetrically arranged lower support feet.

Said chair assembly includes connecting rod, seat, armrest and backrest. Wherein connecting rod can be detachably connected below seat, backrest can be detachably connected behind seat by fasteners, and armrest can be detachably connected on both sides of seat and backrest.

Wherein connecting rod is connected to fixed frame so that swivel chair base and chair assembly are connected as one to form swivel chair.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the drawings.

1000, swivel chair base; 1100, fixed assembly; 1110, fixed frame; 1120, spindle; 1121, clip groove; 2100, sleeve assembly; 2110, upper sleeve; 2120, lower sleeve; 2121, limit notch; 2130, inner core; 2131, clip block; 2132, fixing plate; 3100, support assembly; 3110, upper support foot; 3120, lower support foot; 3130, support bracket; 4000, swivel chair; 4100, chair assembly; 4110, connecting rod; 4120, seat; 4130, armrest; 4131, strut; 4132, support block; 4140, backrest; 4150, placement shelf.

DESCRIPTION OF EMBODIMENTS

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As a preferred embodiment of the present invention, in order to make it more convenient to dismantle and install the swivel chair, to save transportation resources, and to reduce the cost of transportation, the present invention provides a swivel chair base 1000 that is easy to dismantle and transport.

Figure 1:
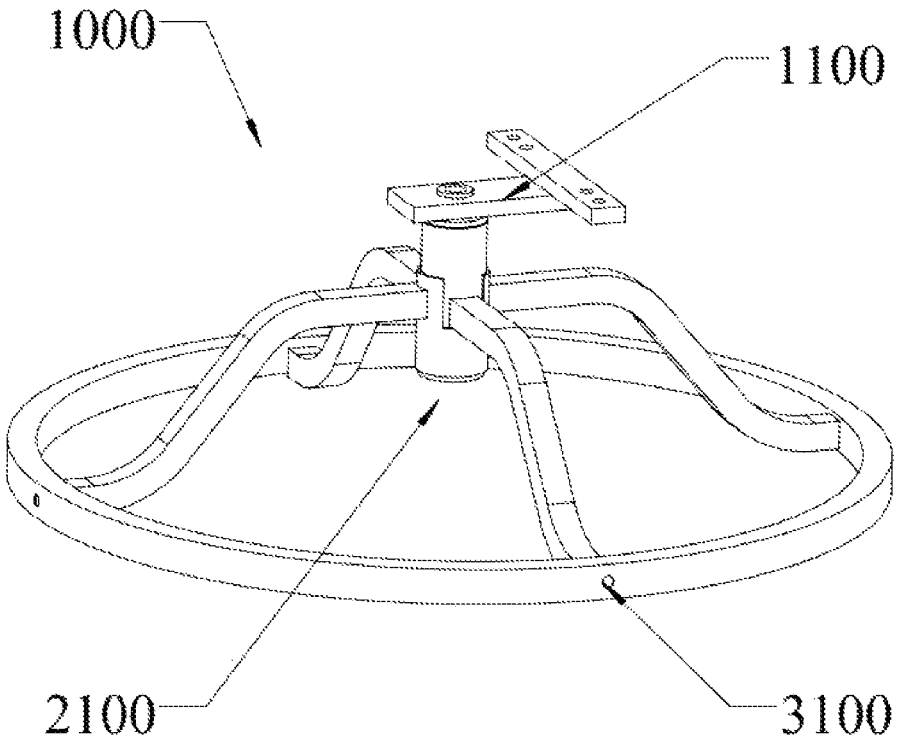
FIG. 1 shows a schematic structural diagram of the present invention application swivel chair base.

As shown in FIG. 1, the swivel chair base 1000 includes a fixed assembly 1100, a sleeve assembly 2100, and a support assembly 3100.

Figure 2:
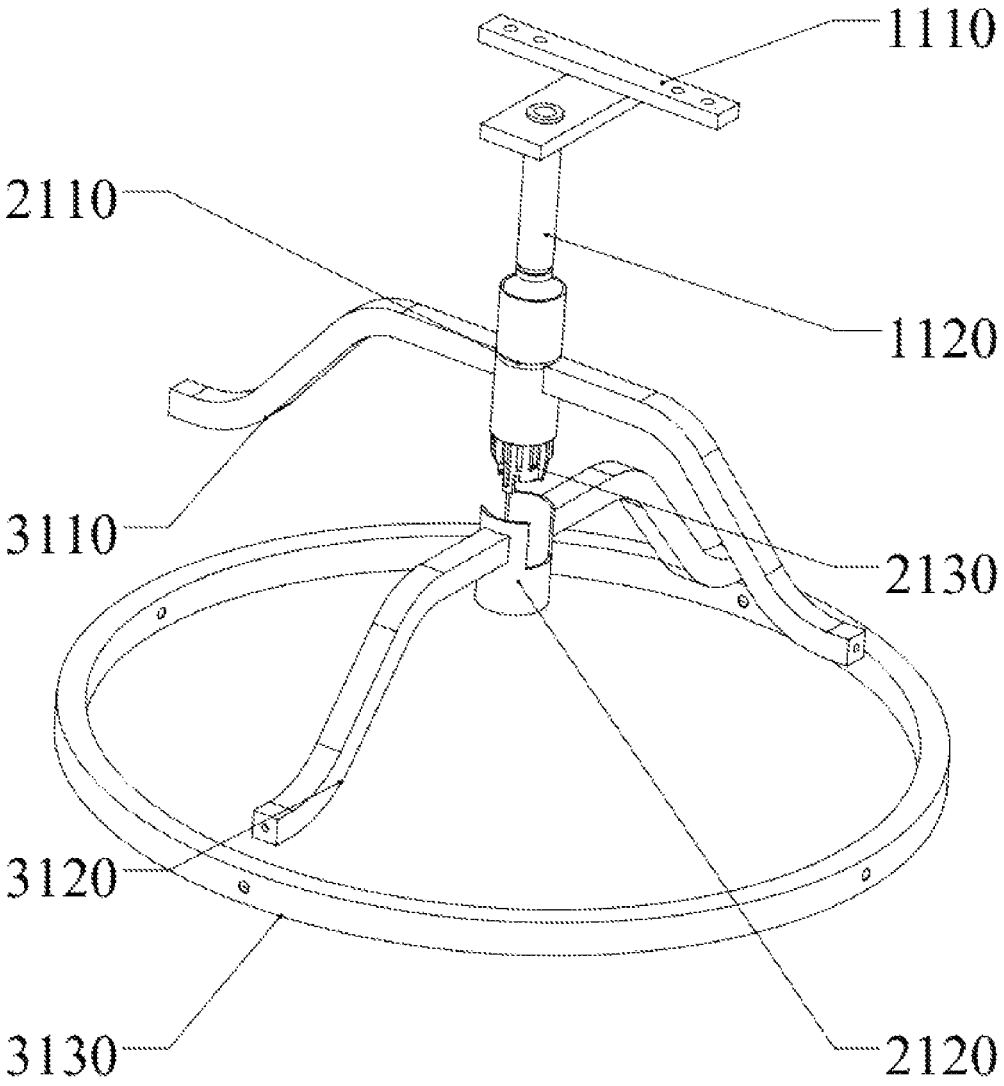
FIG. 2 shows an exploded schematic diagram of the swivel chair base of the present invention application.
Figure 3:
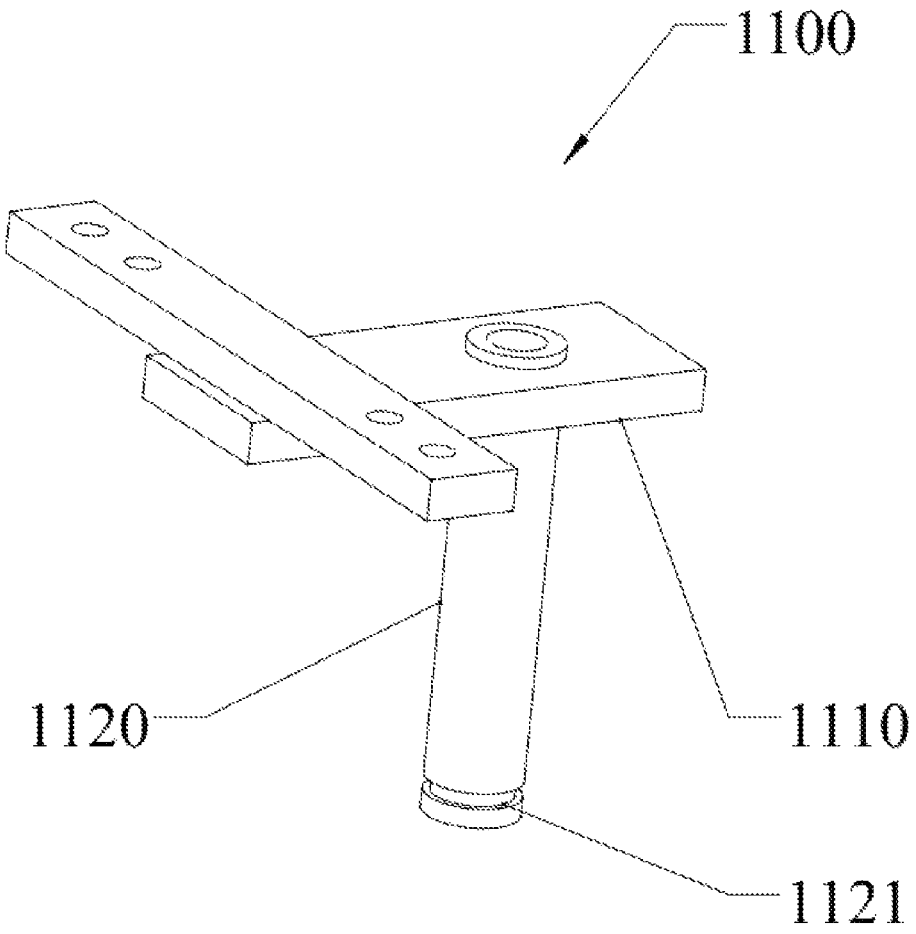
FIG. 3 shows a schematic diagram of the present invention application fixed assembly.

As shown in FIGS. 2 and 3, the fixed assembly 1100 includes a fixed frame 1110 and a spindle 1120.

In this embodiment, the fixed frame 1110 is composed of two square plates with multiple circular holes for connecting the spindle 1120 and other components.

In some embodiments, the fixed frame 1110 can be composed of plates of other geometric shapes such as circular, triangular, or rectangular. In this embodiment, the spindle 1120 is fixedly connected to the fixed frame 1110 through the circular holes of the fixed frame 1110 and is fixed below the fixed frame 1110. this connection method can make the overall connection more firm, not easy to loosen, and improve the stability of the swivel chair base 1000.

In some embodiments, the connection between the fixed frame 1110 and the spindle 1120 can also be welding, threaded connection, buckle connection or other connection fixing methods.

As shown in FIGS. 1 and 2, in this embodiment, the sleeve assembly 2100 includes an upper sleeve 2110 and a lower sleeve 2120. the upper sleeve 2110 is inserted into the lower sleeve 2120 and forms a circumferential fixation. The circumferential fixation fixes the upper sleeve 2110 inside the lower sleeve 2120. the upper sleeve 2110 is fixed to the inner wall of the lower sleeve 2120 all around. The insertion method is that the upper sleeve 2110 is inserted into the lower sleeve 2120 to form a connection with the lower sleeve 2120. the upper sleeve 2110 and lower sleeve 2120 are detachably connected. The detachable connection makes it more convenient for overall assembly and disassembly, and reduces the number of parts required.

It should be further noted that the connection between upper sleeve 2110 and lower sleeve 2120 is not limited to the connection methods listed above. Technical personnel in this field can flexibly adjust and set the connection method between upper sleeve 2110 and lower sleeve 2120 in actual applications, as long as upper sleeve 2110 and lower sleeve 2120 can be connected and fixed, such as key connection, buckle connection, pin connection, pipe connection or other connection fixing methods.

Furthermore, both upper sleeve 2110 and lower sleeve 2120 are cylindrical in shape with a hollow middle part, that is, the middle is hollow and the hollow part runs through the entire part. The material of sleeve assembly 2100 is rigid stainless steel.

In some embodiments, the material of sleeve assembly 2100 can also be iron, steel, carbon fiber material or other rigid materials.

Figure 5:
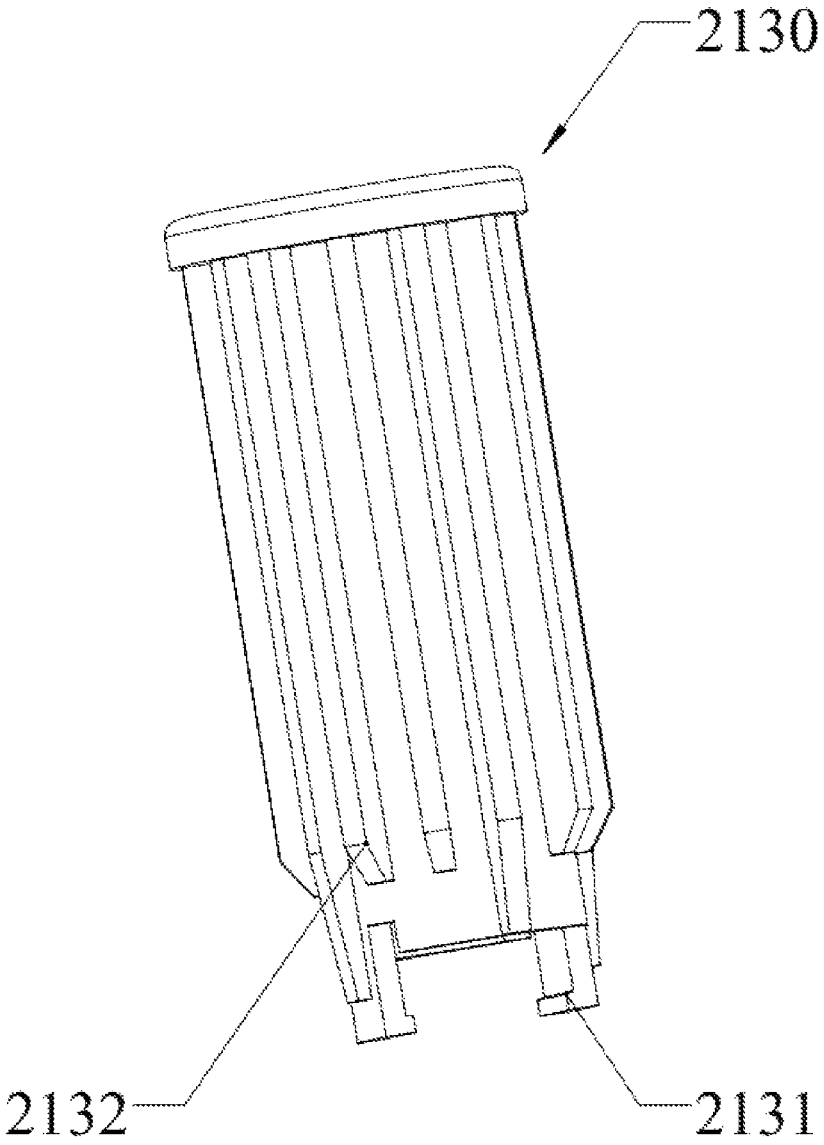
FIG. 5 shows a schematic diagram of inner core of the present invention application.

As shown in FIGS. 2 and 5, in this embodiment, an inner core 2130 is provided inside the upper sleeve 2110. the inner core 2130 is detachably connected to the upper sleeve 2110 by an insertion connection, that is, the inner core 2130 is inserted into the upper sleeve 2110 to form a connection between the two parts.

Furthermore, the inner core 2130 has a cylindrical shape similar to a cylinder. Since the inside of the upper sleeve 2110 is hollow, both ends of the inner core 2130 penetrate inside the upper sleeve 2110 and are fixedly arranged inside the upper sleeve 2110. the inner core 2130 and upper sleeve 2110 form a circumferential fixation, where the inner core 2130 is fixed inside the upper sleeve 2110 and is in contact with the inner wall of the upper sleeve 2110 all around.

In some embodiments, the connection between inner core 2130 and upper sleeve 2110 can be a key connection, buckle connection, pin connection, pipe connection or other connection fixing methods.

In this embodiment, the material of inner core 2130 is rigid material. The material of inner core 2130 can be iron, steel, carbon fiber material or other rigid materials.

In this embodiment, a fixing plate 2132 is provided on the outer wall of inner core 2130. there are multiple fixing plates 2132 arranged along the circumference of inner core 2130 with a certain distance between them. The fixing plate 2132 contacts with the inside of upper sleeve 2110 and forms a connection between inner core 2130 and upper sleeve 2110.

In this embodiment, the middle part of inner core 2130 is hollow and a clip block 2131 is provided at the bottom. One side of clip block 2131 is inclined in shape. A clip groove 1121 is provided at the bottom of spindle 1120. the spindle 1120 is inserted into inner core 2130 and clip block 2131 is connected to clip groove 1121, so that spindle 1120 is connected inside inner core 2130. inner core 2130 and spindle 1120 are detachably connected. The connection through clip block 2131 and clip groove 1121 makes it more convenient for overall assembly and disassembly, and reduces the number of parts required, greatly improving convenience.

Specifically, spindle 1120 is connected to inner core 2130 through clip groove 1121, and inner core 2130 is fixed in upper sleeve 2110 through fixing plate 2132. inner core 2130 is sleeved outside spindle 1120, and upper sleeve 2110 is sleeved outside inner core 2130, thus, spindle 1120, upper sleeve 2110, and inner core 2130 are connected and fixed together.

It should be further noted that the connection between spindle 1120 and inner core 2130 is not limited to the connection methods listed above. Technical personnel in this field can flexibly adjust and set the connection method between spindle 1120 and inner core 2130 in actual applications, as long as spindle 1120 and inner core 2130 can be detachably connected, such as key connection, pin connection, pipe connection or other connection fixing methods.

As shown in FIGS. 1 and 2, in this embodiment, support assembly 3100 includes two upper support feet 3110, two lower support feet 3120, and a support bracket 3130.

Figure 4:
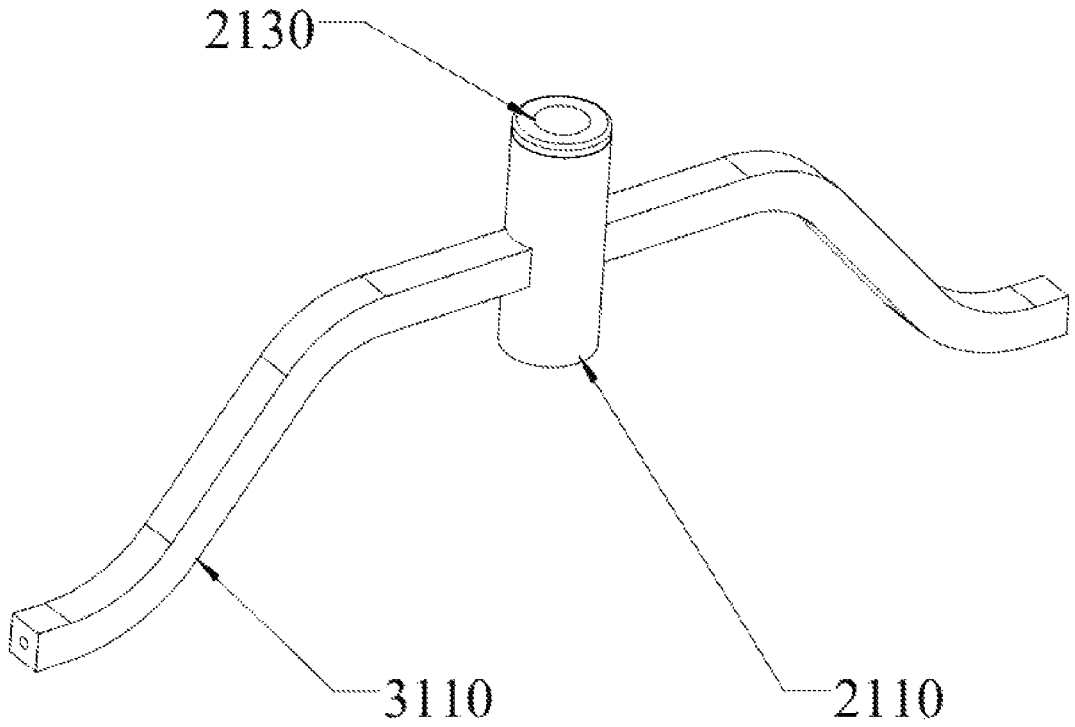
FIG. 4 shows a schematic diagram of upper support foot of the present invention application.
Figure 6:
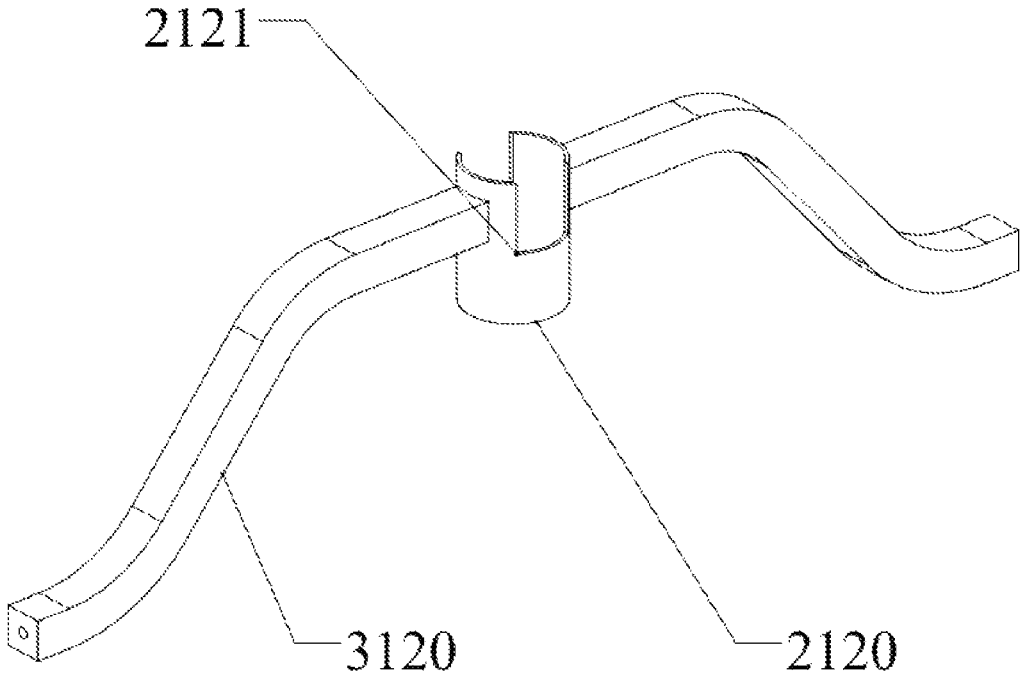
FIG. 6 shows a schematic diagram of lower support foot of the present invention application.

As shown in FIGS. 4 and 6, upper support foot 3110 is symmetrically arranged on the outer wall of upper sleeve 2110, and lower support foot 3120 is symmetrically arranged on the outer wall of lower sleeve 2120.

In this embodiment, two symmetrically arranged limit notches 2121 are provided at the upper end of lower sleeve 2120. when lower sleeve 2120 is connected to upper sleeve 2110, upper support foot 3110 will contact limit notch 2121. upper support foot 3110 will be embedded in limit notch 2121 and fixed in limit notch 2121.

As shown in FIG. 1, upper support foot 3110 and lower support foot 3120 are alternately arranged along the circumference of lower sleeve 2120. upper support foot 3110 and lower support foot 3120 will form a "+" shape.

Figure 7:
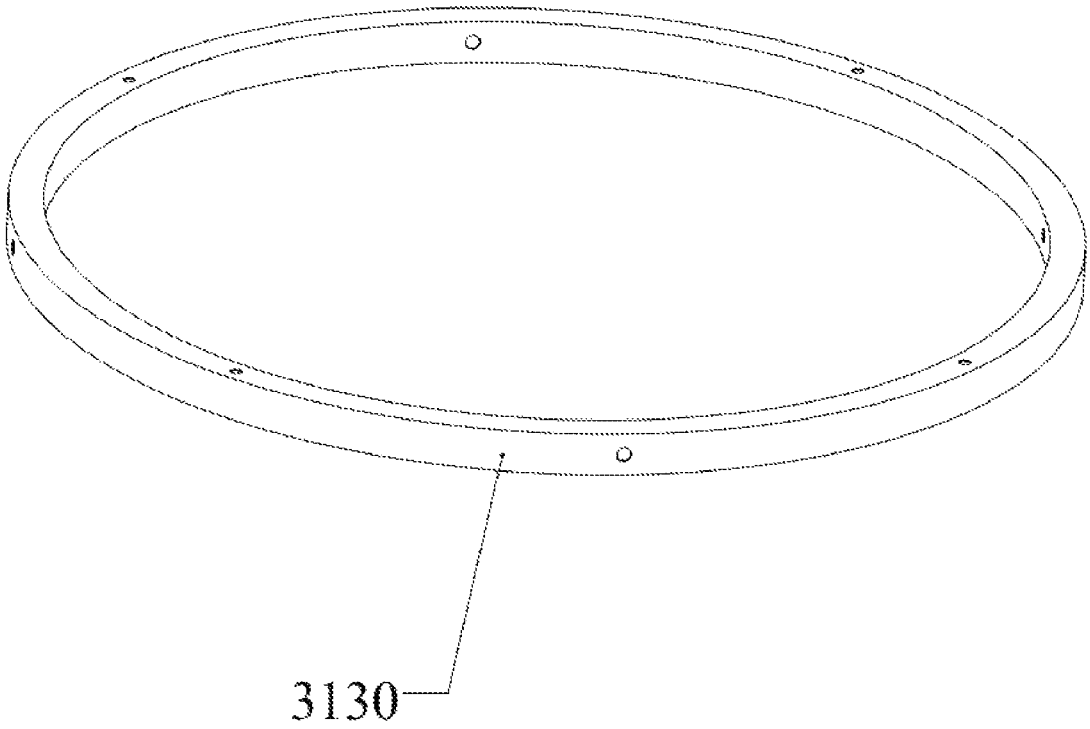
FIG. 7 shows a schematic diagram of support bracket of the present invention application.

As shown in FIG. 7, in this embodiment, support bracket 3130 is a circular structure with thickness and a hollow middle part. There are multiple circular holes on the side wall of support bracket 3130. upper support foot 3110 and lower support foot 3120 are connected to support bracket 3130 by threaded connection. The materials of support bracket 3130, upper support foot 3110 and lower support foot 3120 are all stainless steel.

In some embodiments, the materials of support bracket 3130, upper support foot 3110 and lower support foot 3120 are not limited to the materials listed above. Technical personnel in this field can flexibly adjust and set the use of materials in actual applications, as long as support bracket 3130, upper support foot 3110 and lower support foot 3120 are rigid, such as iron, steel, carbon fiber material, nylon material or other rigid materials.

As a preferred embodiment of the invention, the invention provides a swivel chair 4000 which adds a chair assembly 4100 to the swivel chair base 1000.

Figure 8:
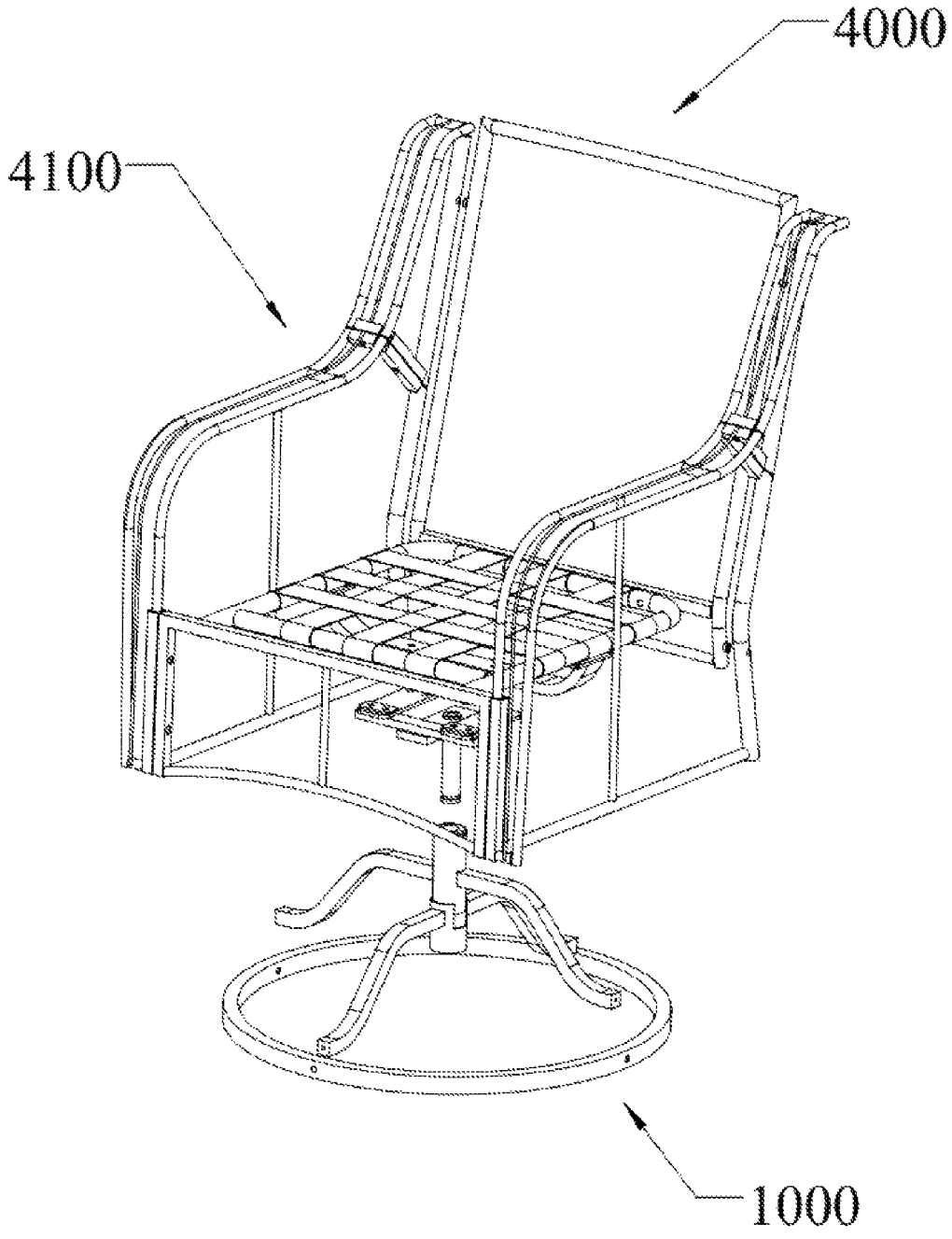
FIG. 8 shows a schematic diagram of a swivel chair with a swivel chair base.

As shown in FIG. 8, swivel chair 4000 includes swivel chair base 1000 and chair assembly 4100.

Figure 9:
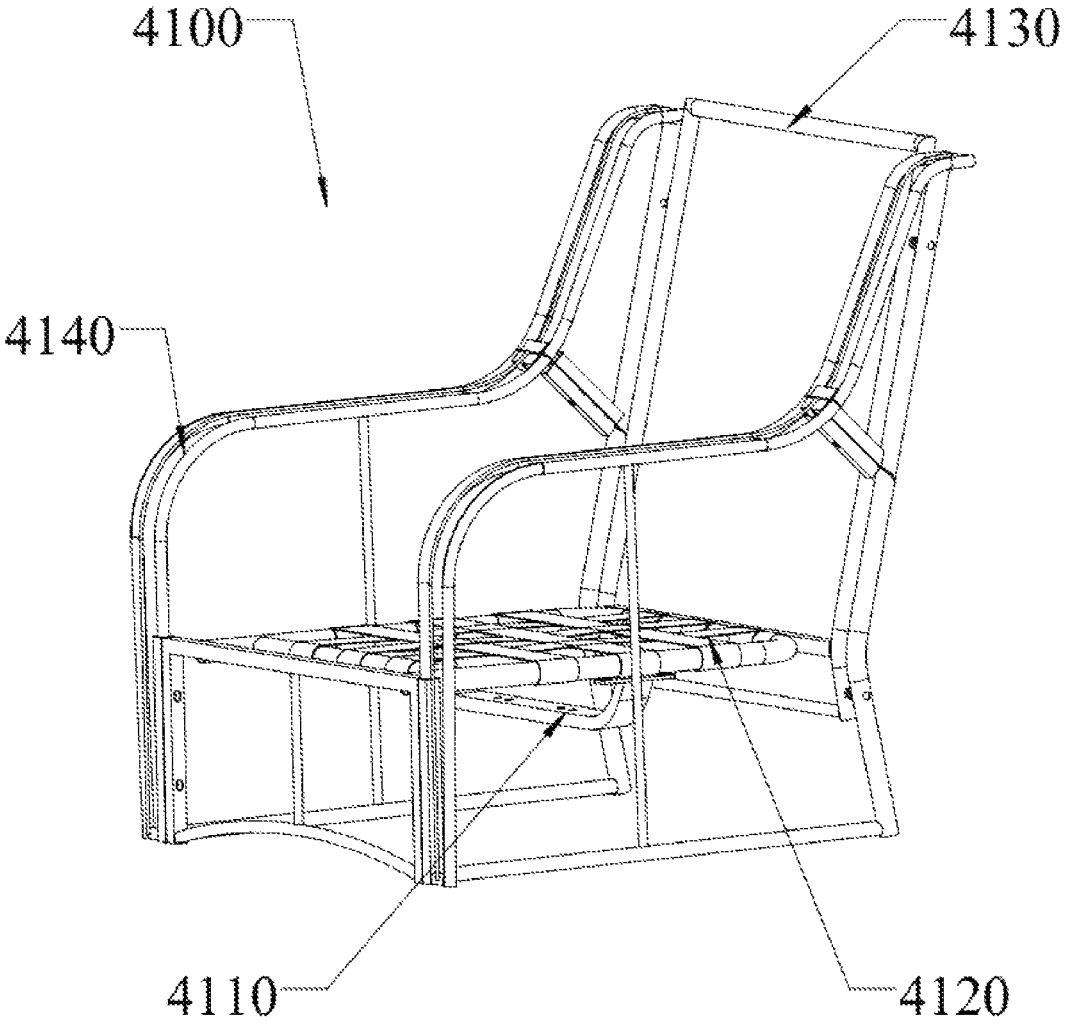
FIG. 9 shows a schematic diagram of the chair assembly of the present invention application.

As shown in FIG. 9, chair assembly 4100 includes connecting rod 4110, seat 4120, armrest 4130 and backrest 4140. connecting rod 4110 is connected below seat 4120 and above fixed frame 1110. connecting rod 4110 is detachably connected to seat 4120 and fixed frame 1110 by threaded connection, so that swivel chair base 1000 and chair assembly 4100 are connected as one to form swivel chair 4000. the threaded connection ensures the stability of the overall structure, the connection is not easy to loosen, improves the stability of the overall structure, and the threaded connection can also be disassembled to improve the convenience of the chair.

In some embodiments, the connection method can also be key connection, buckle connection, pin connection, pipe connection, welding or other connection fixing methods.

In this embodiment, seat 4120 is made of metal material and a grid-like support structure is provided on the surface of seat 4120 frame to improve the stability and support of the structure. In some embodiments, the material can also be iron, steel, carbon fiber material, nylon material or other rigid materials.

The front of seat 4120 is also equipped with a placement shelf 4150. seat 4120 and armrest 4130 are both rotatably connected to placement shelf 4150. placement shelf 4150 has a rotation angle of 0° to 90° and can be used by users to place their legs. Placement shelf 4150 is made of rigid material. In some embodiments, the material can also be iron, steel, carbon fiber material, nylon material or other rigid materials.

In this embodiment, backrest 4140 has a roughly rectangular shape and is made of metal material. Backrest 4140 is detachably connected to the back of seat 4120 by threaded connection. The threaded connection makes the overall structure more stable and not easy to loosen.

In some embodiments, the material can be iron, steel, carbon fiber material, nylon material or other rigid materials. The connection method can also be welding, buckle connection, pin connection or other connection fixing methods. The top height of backrest 4140 is higher than armrest 4130 and conforms to ergonomic structure. At the same time, backrest 4140 is inclined and has a swing angle. Backrest 4140 has an inclination angle of 0° to 30°. Users can adjust it according to their comfort level.

Figure 10:
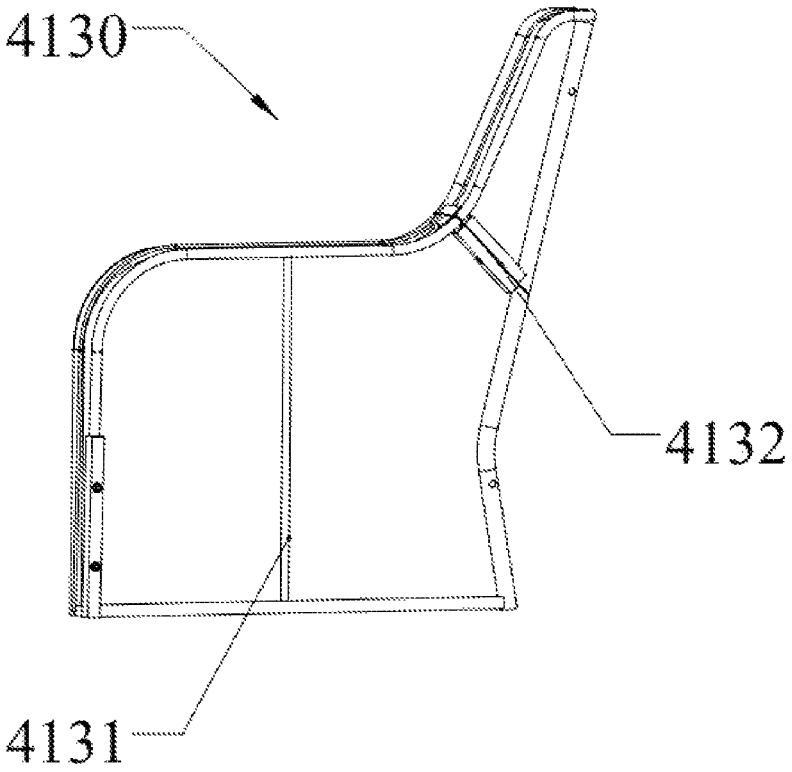
FIG. 10 shows a schematic diagram of armrest of the present invention application.

As shown in FIG. 10, in this embodiment, armrest 4130 is arc-shaped and forms an enclosed space. Armrest 4130 is detachably connected to the sides of seat 4120 and backrest 4140 by threaded connection. Armrest 4130 is made of metal material.

In some embodiments, the connection method can be welding, buckle connection, pin connection or other connection fixing methods. The material can be iron, steel, carbon fiber material, nylon material or other rigid materials. Inside the frame of armrest 4130, a strut 4131 and a support block 4132 are provided. Strut 4131 supports between the top and bottom of armrest 4130 frame, and support block 4132 is provided inside the frame where the arm is placed. Strut 4131 and support block 4132 support the overall frame to make the structure of armrest 4130 more firm. The swivel chair base of the present invention can be applied to multiple fields. For example, it can be used in office chairs to make it easier for people to move and rotate in the office. In addition, swivel seats can also be used in car seats to make it easier for passengers to get in and out of the car.

Furthermore, swivel seats can also be used in furniture design, such as dining chairs or living room armchairs, to provide users with more comfort and flexibility.

In summary, this invention application saves transportation resources and space through its unique disassembly method and base structure, thereby reducing transportation costs. The swivel chair base has a simple and detachable structure, with the advantages of easy disassembly and assembly, easy operation, and space saving, further improving the user experience.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

What is claimed is:

1. A swivel chair base, comprising:

a fixed assembly, a sleeve assembly and a support assembly, said fixed assembly includes a fixed frame and a spindle, with said spindle fixed below said fixed frame;

said sleeve assembly includes an upper sleeve and a lower sleeve, with said upper sleeve inserted into said lower sleeve and forming a circumferential fixation;

said support assembly includes at least two symmetrically arranged upper support feet, at least two symmetrically arranged lower support feet and a support bracket, with said at least two symmetrically arranged upper support feet and said at least two symmetrically arranged lower support feet respectively detachably connected to said support bracket by fasteners;

wherein, said spindle is detachably connected to said upper sleeve, an outer wall of said upper sleeve has said at least two symmetrically arranged upper support feet, and the outer wall of said lower sleeve has said at least two symmetrically arranged lower support feet.

2. The swivel chair base according to claim 1, wherein, said upper sleeve and said lower sleeve are cylindrical in structure, hollow inside, and made of rigid material.

3. The swivel chair base according to claim 2, wherein, said inner core is provided inside said upper sleeve, and inner core is detachably connected to said upper sleeve by an insertion connection.

4. The swivel chair base according to claim 3, wherein, said inner core is cylindrical in shape, with both ends penetrating and circumferentially positioned inside said upper sleeve.

5. The swivel chair base according to claim 4, wherein, several vertically arranged fixing plates are spaced along the circumference on an outer wall of said inner core, and fixing plate is connected to an inner wall of said upper sleeve.

6. The swivel chair base according to claim 5, wherein, a bottom of said spindle is provided with a clip groove, a bottom of said inner core is provided with a clip block, which is inclined in shape, and the bottom of said inner core is connected inside the bottom of said spindle.

7. The swivel chair base according to claim 6, wherein, said lower sleeve has two symmetrically arranged limit notches at an upper end of said lower sleeve, and said at least two symmetrically arranged upper support feet are correspondingly embedded and positioned in said limit notches.

8. The swivel chair base according to claim 7, wherein, said at least two symmetrically arranged upper support feet and said at least two symmetrically arranged lower support feet are alternately arranged along the circumference of said lower sleeve.

9. The swivel chair base according to claim 8, wherein, said support bracket is circular in structure, and the materials of said support bracket, said at least two symmetrically arranged upper support feet and said at least two symmetrically arranged lower support feet are all rigid materials.

10. A swivel chair, comprising:

a swivel chair base and a chair assembly, said swivel chair base includes a fixed assembly, a sleeve assembly and a support assembly, said fixed assembly includes a fixed frame and a spindle, with said spindle fixed below said fixed frame, said sleeve assembly includes an upper sleeve and a lower sleeve, with an inner core provided inside said upper sleeve, several vertically arranged fixing plates spaced along the circumference on an outer wall of said inner core, and said upper sleeve inserted into said lower sleeve to form a circumferential fixation-, said support assembly includes at least two symmetrically arranged upper support feet, at least two symmetrically arranged lower support feet and support bracket, with said at least two symmetrically arranged upper support feet and said at least two symmetrically arranged lower support feet, respectively, detachably connected to said support bracket by fasteners, wherein, a bottom of said spindle is provided with a clip groove, a bottom of said inner core is provided with a clip block, the bottom of said inner core is connected inside the bottom of said spindle, an outer wall of said upper sleeve has said at least two symmetrically arranged upper support feet, and the outer wall of said lower sleeve has said at least two symmetrically arranged lower support feet;

said chair assembly includes a connecting rod, a seat, an armrest and a backrest, wherein said connecting rod can be detachably connected to said seat, said backrest can be detachably connected behind said seat by fasteners, and said armrest can be detachably connected on both sides of said seat and said backrest;

wherein said connecting rod is connected to said fixed frame so that said swivel chair base and said chair assembly are connected as one to form said swivel chair.

11. The swivel chair according to claim 10, wherein, said connecting rod is detachably connected to said fixed frame by fasteners, with said fixed frame located below said connecting rod.

12. The swivel chair according to claim 11, wherein, said connecting rod and said seat are detachably connected by fasteners, with said seat located above said connecting rod.

13. The swivel chair according to claim 12, wherein, said connecting rod, said fixed frame, and said seat are all detachably connected by a threaded connection.

14. The swivel chair according to claim 13, wherein, said seat is made of metal material and has a support structure.

15. The swivel chair according to claim 14, wherein, a placement shelf is provided at a front of said seat, and said placement shelf is rotatably connected to said seat and said armrest.

16. The swivel chair according to claim 15, wherein, said placement shelf is made of rigid material and has a rotation angle of 0° to 90°.

17. The swivel chair according to claim 16, wherein, said backrest is roughly rectangular in shape, made of metal material, and a top of said backrest is higher than a top of said armrest.

18. The swivel chair according to claim 17, wherein, said backrest is inclined and has an inclination angle of 0° to 30°.

19. The swivel chair according to claim 18, wherein, a strut and a support block are provided inside said armrest, and said strut and said support block support an overall frame of said armrest.

20. The swivel chair according to claim 19, wherein, said armrest is arc-shaped, forming an enclosed space, and made of metal material.

* * * * *